US007450070B2

(12) United States Patent
Chang et al.

(10) Patent No.: US 7,450,070 B2
(45) Date of Patent: Nov. 11, 2008

(54) ANTENNAS

(75) Inventors: Yuan-Li Chang, Taipei (TW); Chih-Ming Wang, Taipei (TW)

(73) Assignee: Wistron NeWeb Corp., Taipei Hsien (TW)

( * ) Notice: Subject to any disclaimer, the term of this patent is extended or adjusted under 35 U.S.C. 154(b) by 50 days.

(21) Appl. No.: 11/564,226

(22) Filed: Nov. 28, 2006

(65) Prior Publication Data

US 2007/0096998 A1 May 3, 2007

Related U.S. Application Data

(62) Division of application No. 11/128,817, filed on May 12, 2005, now Pat. No. 7,170,450.

(30) Foreign Application Priority Data

Oct. 28, 2004 (TW) ..... 93132684 A

(51) Int. Cl.
*H01Q 1/38* (2006.01)

(52) U.S. Cl. ..... 343/700 MS; 343/702

(58) Field of Classification Search ..... 343/700 MS
See application file for complete search history.

(56) References Cited

U.S. PATENT DOCUMENTS

| | | | | |
|---|---|---|---|---|
| 6,985,114 | B2 * | 1/2006 | Egashira | 343/702 |
| 7,026,999 | B2 * | 4/2006 | Umehara et al. | 343/702 |
| 7,148,849 | B2 * | 12/2006 | Lin | 343/700 MS |
| 2002/0190905 | A1 | 12/2002 | Flint et al. | |
| 2004/0046097 | A1 * | 3/2004 | Dai et al. | 343/700 MS |
| 2004/0104853 | A1 * | 6/2004 | Chen | 343/702 |
| 2004/0108957 | A1 * | 6/2004 | Umehara et al. | 343/700 MS |
| 2004/0222923 | A1 * | 11/2004 | Erkocevic | 343/700 MS |

* cited by examiner

*Primary Examiner*—Trinh V Dinh
(74) *Attorney, Agent, or Firm*—Quintero Law Office

(57) ABSTRACT

An antenna comprises a first metal element, a second metal element, a third metal element, a ground element and a cable. The first metal element and the second metal element are connected to the ground element. The third metal element is disposed on the first metal element. The cable is coupled to the first metal element. The antenna has three different resonant frequencies (a first resonant frequency, a second resonant frequency and a third resonant frequency) for transmitting three signals in different frequency bands.

6 Claims, 6 Drawing Sheets

ANTENNAS

This application is a divisional of U.S. application Ser. No. 11/128,817, filed May 12, 2005, now U.S. Pat. No. 7,170,450 the entire disclosure of which is hereby incorporated by reference.

BACKGROUND

The invention relates to antennas, and more particularly to antennas utilized in a portable electronic device.

Antennas are utilized in various portable electronic devices, such as notebooks, for transmitting wireless signals. With reference to FIG. 1, U.S. Pat. No. 6,686,886 discloses antennas 501 and 502 utilized in a notebook. The antennas 501 and 502 are near a screen of the notebook and transmit wireless signals. The antennas 501 and 502 are oriented in different directions to improve transmission.

The antennas 501 and 502 are flat antennas. FIG. 2 shows the detailed structure of antennas 501 and 502, which comprise a first inverted L-shaped structure (composed of metal elements 702 and 703), a second inverted L-shaped structure (composed of metal elements 704 and 708), a cable 706 and a ground element 701. The first and second inverted L-shaped structures are coupled to the ground element 701. The cable 706 comprises a data line 705 and a ground line 707, the data line 705 is coupled to the metal element 703, and the ground line 707 is coupled to the ground element 701. The first and second inverted L-shaped structures each have two different resonant frequency transmitting wireless signals with two different frequency bands. Antennas 501 and 502, however, cannot transmit wireless signals in more than three different frequency bands, for example, signals comprising GSM900, DCS1800 and WLAN signals.

SUMMARY

Antennas are provided. An exemplary embodiment of an antenna comprises a first metal element, a second metal element, a third metal element, a ground element and a cable. The first metal element and the second metal element are connected to the ground element. The third metal element is disposed on the first metal element. The cable is coupled to the first metal element. The antenna has three different resonant frequencies (a first resonant frequency, a second resonant frequency and a third resonant frequency) transmitting three signals in different frequency bands.

The antenna of the invention transmits signals in three different frequency bands with a simpler and smaller antenna structure and obtains improved transmission effect over the conventional.

BRIEF DESCRIPTION OF THE DRAWINGS

The invention will be more fully understood from the following detailed description and the accompanying drawings, given by the way of illustration only and thus not intended to limit the disclosure.

DETAILED DESCRIPTION

FIRST EMBODIMENT

The invention provides a flat antenna transmitting three wireless signals, via the principle of current coupling, in different frequency bands, and more particularly an antenna integrating inverted F-shaped, L-shaped and slot antenna structures for transmitting three wireless signals.

Figure 1:
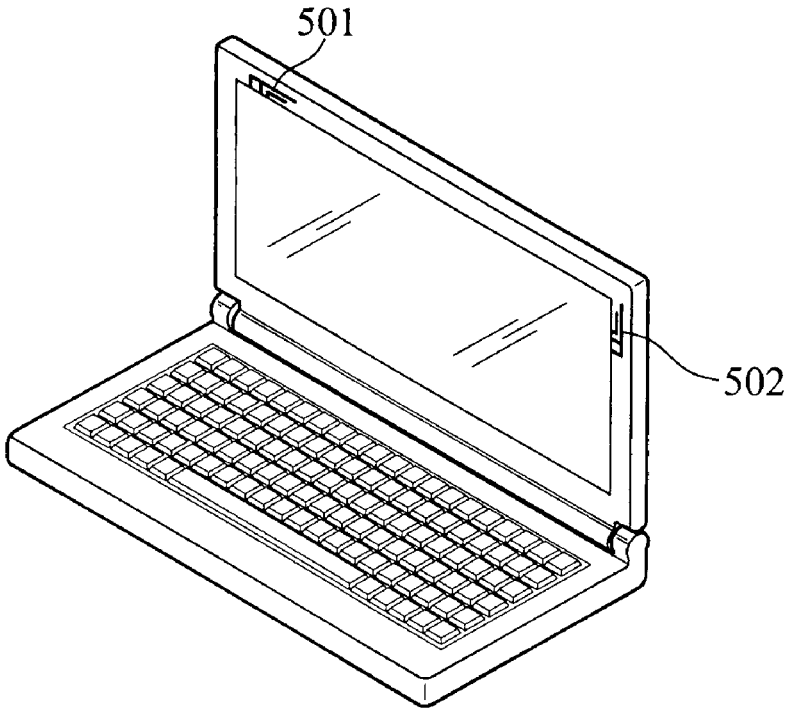
FIG. 1 ( RELATED ART )
FIG. 1 shows conventional antennas disposed in a notebook.
Figure 2:
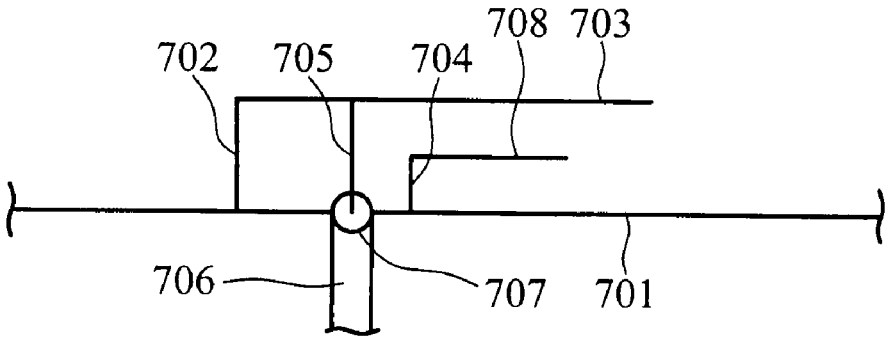
FIG. 2 ( RELATED ART )
FIG. 2 shows structure of the conventional antenna in detail.
Figure 3:
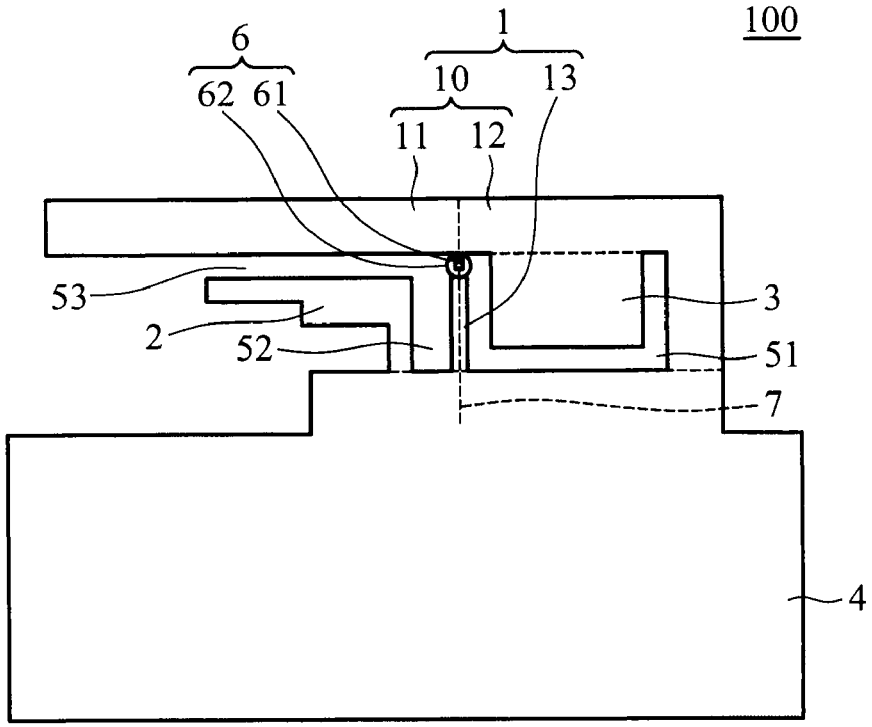
FIG. 3 shows an antenna of a first embodiment of the invention.

FIG. 3 shows an antenna 100 of the first embodiment of the invention, which comprises a first metal element 1, a second metal element 2, a third metal element 3, a ground element 4 and a cable 6. The first metal element 1 and the second metal element 2 are connected to the ground element 4. The third metal element 3 is disposed on the first metal element 1. The cable 6 is coupled to the first metal element 1. The antenna 100 has three different resonant frequencies (a first resonant frequency, a second resonant frequency and a third resonant frequency) transmitting three signals in different frequency bands. The operation of the antenna 100 is described hereafter.

Figure 4A:
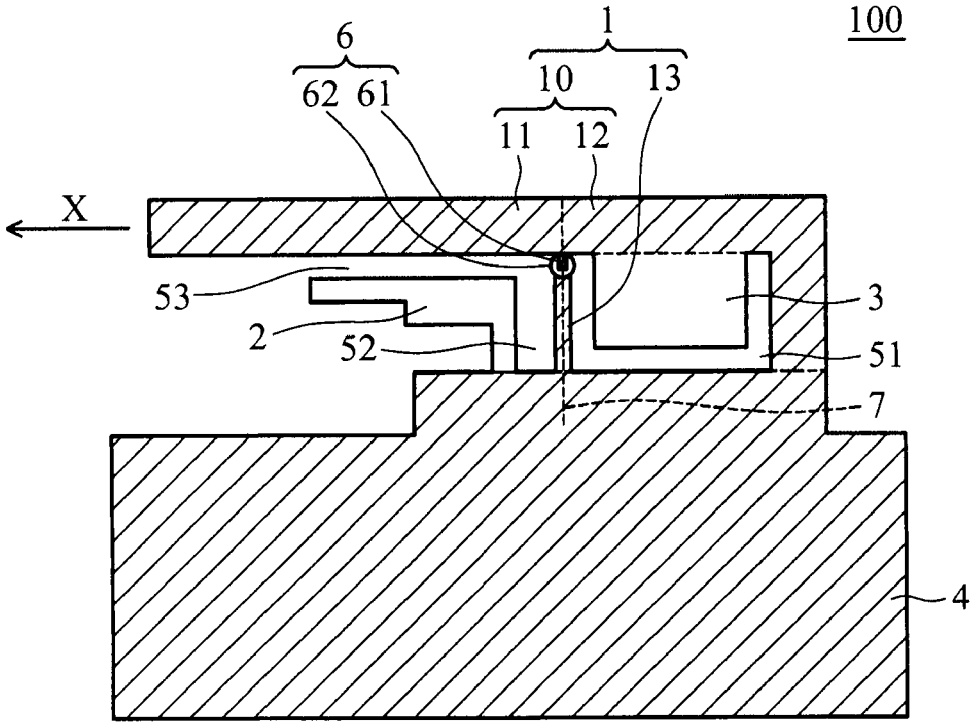
FIG. 4*a* shows a first radiation element of the first embodiment.

As shown in FIG. 4*a*, the first metal element 1 and the ground element 4 together compose a first radiation element (marked by oblique lines) providing the first resonant frequency. The first metal element 1 comprises a first element body 10 and a feed conductor 13. The first element body 10 comprises a first portion 11 and a second portion 12 divided by a straight line 7. The first portion 11 is longitudinal and extends in a first direction X and the second portion is an inverted L-shape. The first element body 10 and the feed conductor 13 are connected to the ground element 4. The feed conductor 13 is longitudinal, extending along the straight line 7, and a gap is formed between an end thereof and the first element body 10. The straight line 7 is perpendicular to the first direction X. The cable 6 comprises a data line 61 and a ground layer (ground line) 62 enclosing the data line 61. The ground line 62 is coupled to an end of the feed conductor 13, and the data line 61 is coupled to the first element body 10 corresponding to the end of the feed conductor 13. The first radiation element is an inverted F-shaped structure providing the first resonant frequency for transmitting a GSM900 signal.

Figure 4B:
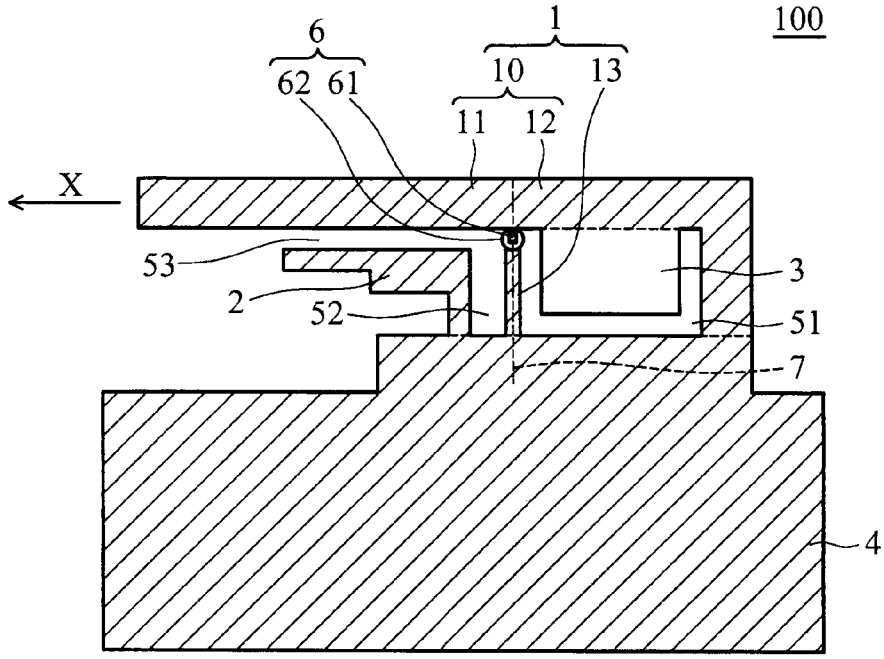
FIG. 4*b* shows a second radiation element of the first embodiment.

As shown in FIG. 4*b*, the first metal element 1, the second metal element 2 and the ground element 4 compose a second radiation element (marked by oblique lines) providing the second resonant frequency obtained from the instance of current coupling between the first metal element 1 and the second metal element 2, particularly ground-induced current coupling between the second metal element 2 and the grounded feed conductor 13. Meanwhile, current coupling also occurs between the second metal element 2 and the first element body 10. The second metal element 2 is substantially an inverted L-shape, an end thereof is connected to the ground element 4, and the other end thereof extends toward the first direction X. Slots 52 and 53 are formed between the second metal element 2 and the first metal element 1. The second radiation element transmits a DCS1800 signal.

Figure 4C:
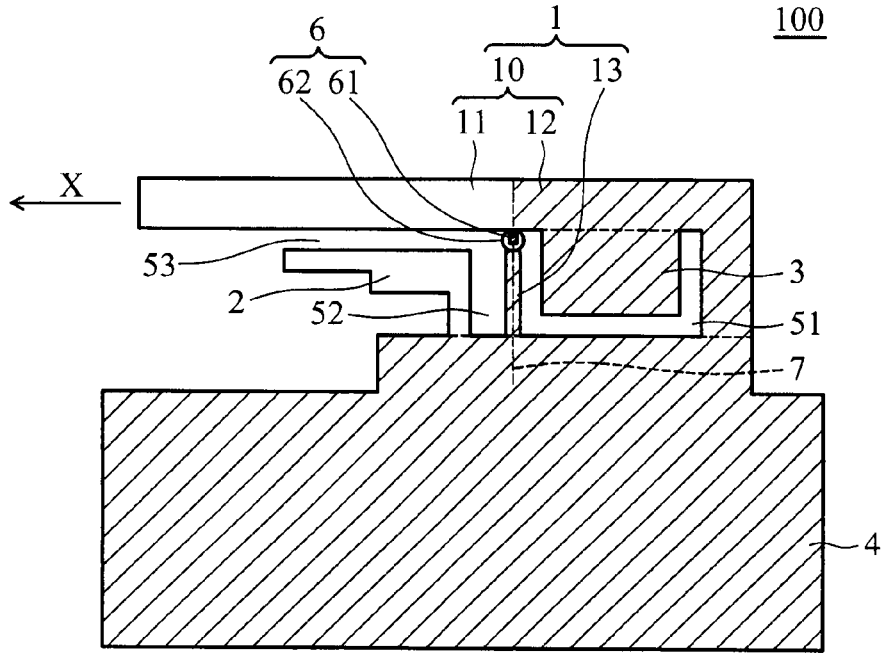
FIG. 4*c* shows a third radiation element of the first embodiment.

As shown in FIG. 4*c*, the third metal element 3, the ground element 4, the feed conductor 13 and the second portion 12 comprise a third radiation element (marked by oblique lines) providing the third resonant frequency. The third metal element 3 is oblong and disposed on the second portion 12. The third radiation element is a slot antenna structure comprising a U-shaped slot 51 for transmitting a WLAN signal.

The antenna of the invention transmits signals in three different frequency bands with a simpler and smaller antenna structure and obtains improved transmission effect over the conventional.

SECOND EMBODIMENT

Figure 5:
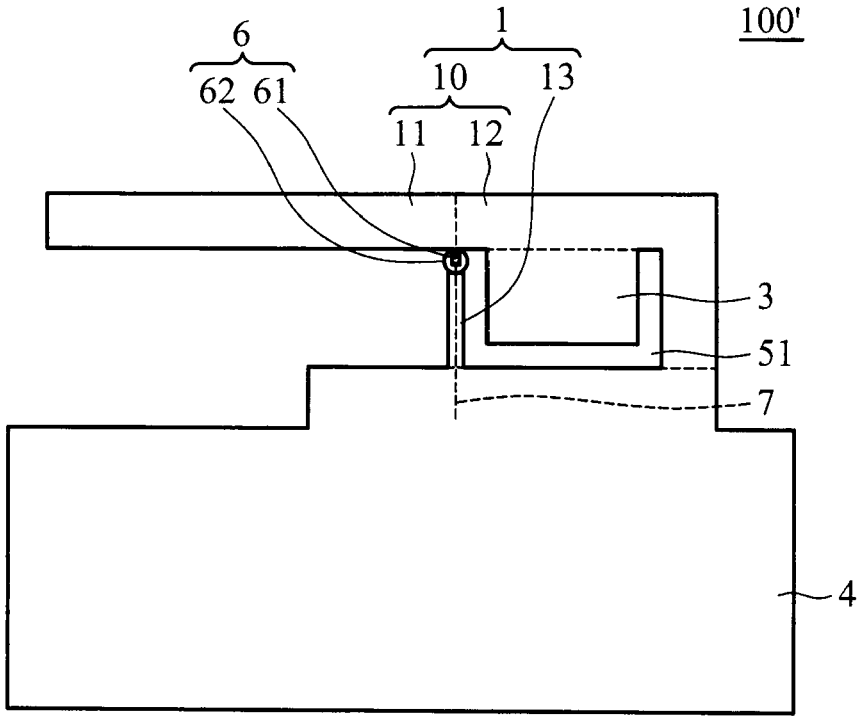
FIG. 5 shows an antenna of a second embodiment of the invention.
Figure 6A:
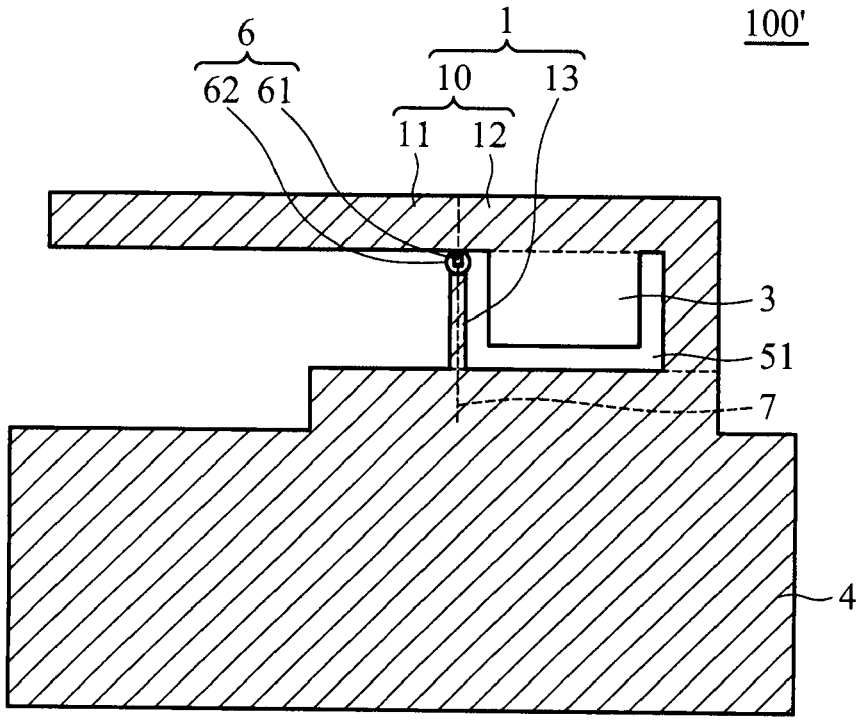
FIG. 6*a* shows a radiation element of the second embodiment having a first resonant frequency.
Figure 6B:
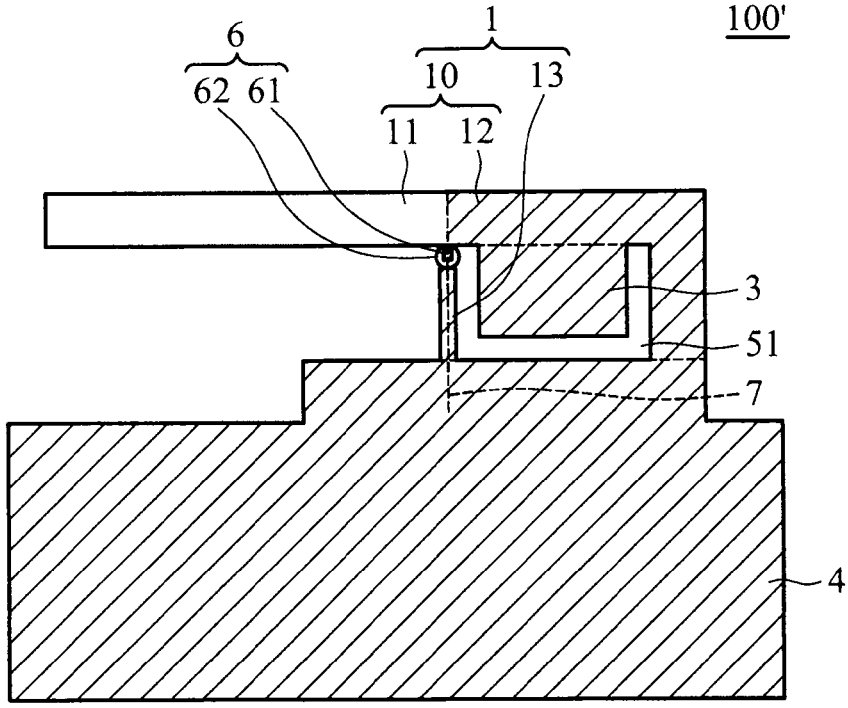
FIG. 6*b* shows a radiation element of the second embodiment having a third resonant frequency.

The invention can also be utilized in transmitting signals with in different frequencies rather than three different frequencies. FIG. 5 shows an antenna 100' of a second embodiment of the invention, which omits the second metal element, and has the first resonant frequency (provided by radiation element marked by oblique lines in FIG. 6*a*) and the third resonant frequency (provided by radiation element marked by oblique lines in FIG. 6*b*). The second embodiment of the invention can be utilized independently or combined with other antenna structures.

THIRD EMBODIMENT

Figure 7:
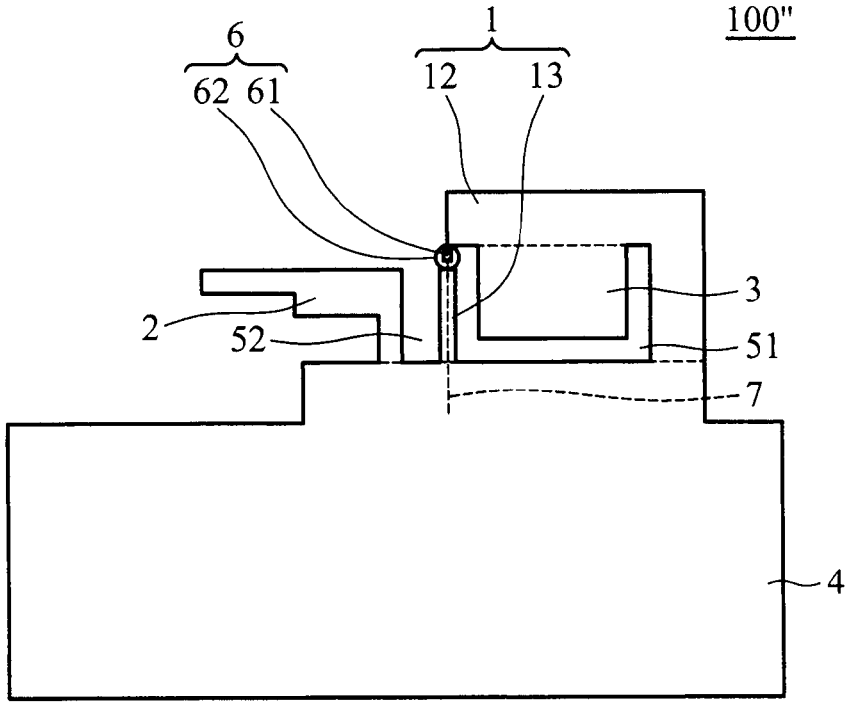
FIG. 7 shows an antenna of a third embodiment of the invention.
Figure 8A:
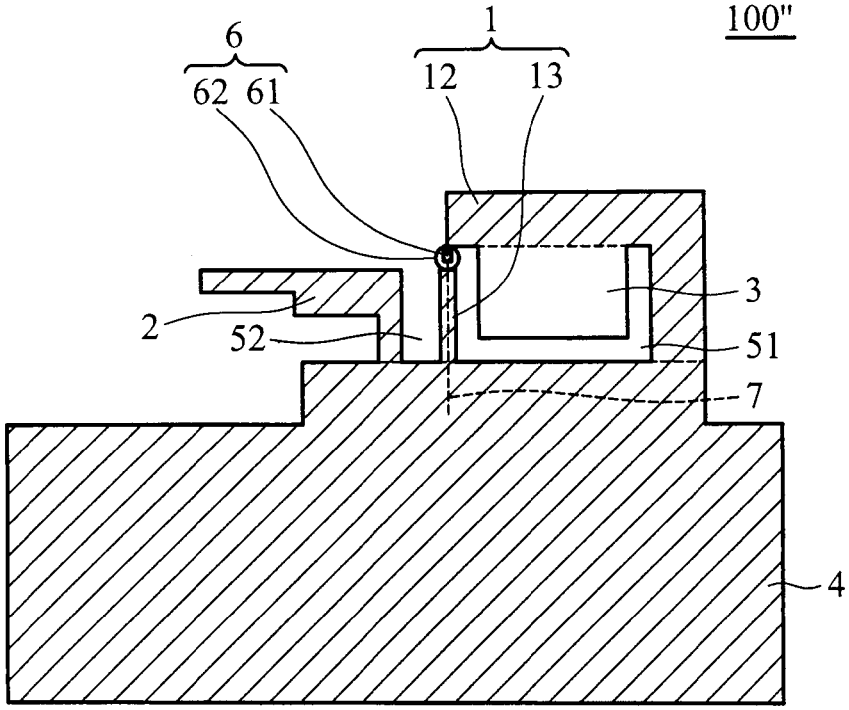
FIG. 8*a* shows a radiation element of the third embodiment having a second resonant frequency.
Figure 8B:
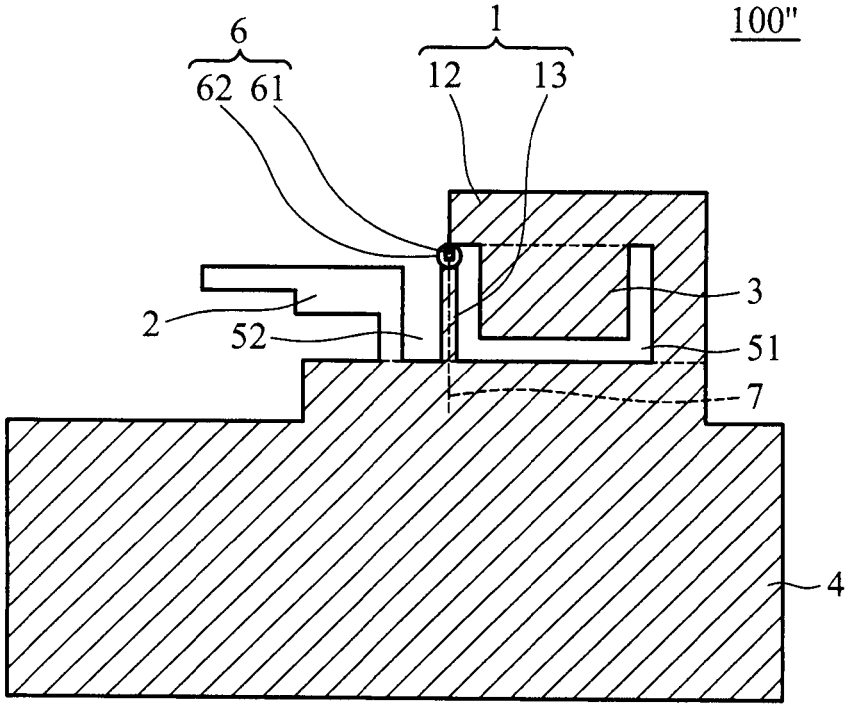
FIG. 8*b* shows a radiation element of the third embodiment having the third resonant frequency.

FIG. 7 shows a third embodiment of the invention, which omits the first portion, and has the second resonant frequency (provided by radiation element marked by oblique lines in FIG. 8*a*) and the third resonant frequency (provided by radiation element marked by oblique lines in FIG. 8*b*). With reference to FIG. 8*a*, the feed conductor 13 is grounded, and the second resonant frequency is obtained from ground-induced current coupling between the second metal element 2 and the grounded feed conductor 13. The third embodiment of the invention can be utilized independently or combined with other antenna structures.

While the invention has been described by way of example and in terms of preferred embodiment, it is to be understood that the invention is not limited thereto. To the contrary, it is intended to cover various modifications and similar arrangements (as would be apparent to those skilled in the art). Therefore, the scope of the appended claims should be accorded the broadest interpretation to encompass all such modifications and similar arrangements.

What is claimed is:

1. An antenna, comprising:

a ground element;

a first metal element comprising a portion and a feed conductor, the portion and the feed conductor connected to the ground element, wherein the first metal element and the ground element compose a first radiation element having a first resonant frequency;

a third metal element disposed on the portion, wherein the third metal element, the feed conductor, the ground element and the portion compose a third radiation element having a third resonant frequency;

a second metal element disposed on the ground element, wherein the portion, the second metal element, the feed conductor and the ground element compose a second radiation element having a second resonant frequency;

a data line coupled to the portion; and a ground line, coupled to the feed conductor, wherein the second resonant frequency is obtained by current coupling between the feed conductor and the second metal element.

2. The antenna as claimed in claim 1, wherein the portion is an inverted L-shape, and an end thereof is connected to the ground element, and the other end thereof extends in a first direction.

3. The antenna as claimed in claim 2, wherein the feed conductor is longitudinal and extends along a straight line perpendicular to the first direction.

4. The antenna as claimed in claim 3, wherein the third metal element is oblong, and the third metal element, the feed conductor, the ground element and the portion comprise a U-shaped slot antenna structure.

5. The antenna as claimed in claim 1, wherein the second metal element is an inverted L-shape, and an end thereof is connected to the ground element, and the other end thereof extends in a first direction.

6. The antenna as claimed in claim 5, wherein the feed conductor is longitudinal, and a slot is formed between the feed conductor and the second metal element.

* * * * *